United States Patent [19]

Pearce

[11] Patent Number: 4,509,879

[45] Date of Patent: Apr. 9, 1985

[54] JOINING SYSTEM FOR TRIANGULATED STRUCTURES

[75] Inventor: Peter J. Pearce, 3838 Carpenter Ave., Studio City, Calif. 91604

[73] Assignee: Peter Pearce, Los Angeles, Calif.

[21] Appl. No.: 245,551

[22] PCT Filed: Oct. 3, 1978

[86] PCT No.: PCT/US78/00100

§ 371 Date: Jun. 4, 1979

§ 102(e) Date: Jun. 4, 1979

[87] PCT Pub. No.: WO79/00176

PCT Pub. Date: Apr. 5, 1979

[30] Foreign Application Priority Data

Oct. 3, 1977 [GB] United Kingdom ..... 41000/77

[51] Int. Cl.[3] ..... F16B 7/00

[52] U.S. Cl. ..... 403/172; 403/217; 52/80

[58] Field of Search ..... 403/170, 171, 172, 173, 403/174, 175, 176, 177, 178, 161, 119, 65, 64, 163, 217; 52/646, 80, 81; 135/4 R, 4 C, 15 PQ, DIG. 9

[56] References Cited

U.S. PATENT DOCUMENTS

| | | | |
|---|---|---|---|
| 1,526,016 | 2/1925 | Scott | 135/4 R |
| 1,709,568 | 4/1929 | Frank | 135/4 R |
| 1,803,508 | 5/1931 | Rossman | 403/173 |
| 2,323,870 | 7/1943 | Kaliska | 16/392 X |
| 2,716,993 | 9/1955 | Codrick | 135/4 R |
| 2,986,241 | 5/1961 | Fuller | 403/173 X |
| 3,100,555 | 8/1963 | Ashton | 403/172 |
| 3,332,195 | 7/1967 | Foster | 403/196 X |
| 3,507,526 | 4/1970 | Packman et al. | 403/173 |
| 3,521,421 | 7/1970 | Schroeder | 403/53 X |
| 3,600,825 | 8/1971 | Pearce | 403/176 |

FOREIGN PATENT DOCUMENTS

| | | | |
|---|---|---|---|
| 767058 | 4/1934 | France | 403/161 |
| 951883 | 4/1949 | France | 403/217 |
| 6508364 | 12/1965 | Netherlands | 403/174 |
| 213713 | 6/1941 | Switzerland | 403/217 |

*Primary Examiner*—Andrew V. Kundrat

*Attorney, Agent, or Firm*—Marvin H. Kleinberg

[57] ABSTRACT

The invention is directed to structural elements for use in triangulated structures, and structures assembled from such elements. In particular the invention provides an elongated structural element for use in a triangulated structural assembly, provided at at least one end thereof with connector means adapted for pivotal connection directly to at least one further structural element about a pivot axis which is transverse to the longitudinal axis of the structural element and which is disposed outside the general envelope of the structural element itself. The arrangement is such that from two to as many as one hundred such structural elements may be interconnected at a structural node without the use of an intermediate nodal member.

15 Claims, 52 Drawing Figures

FIG. 1a
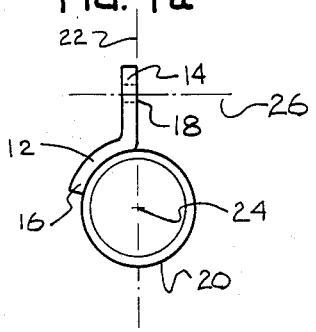
FIG. 1b
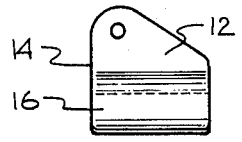
FIG. 2a
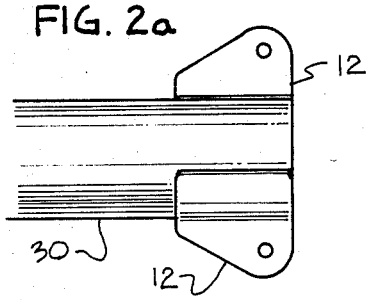
FIG. 2b
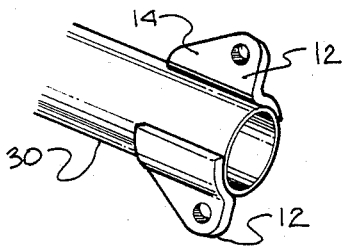
FIG. 2d
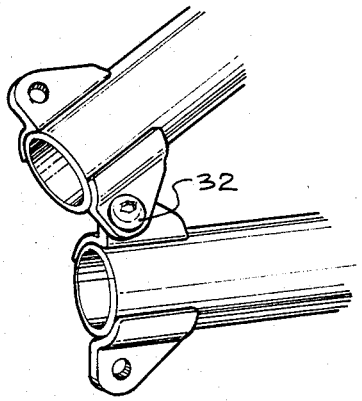
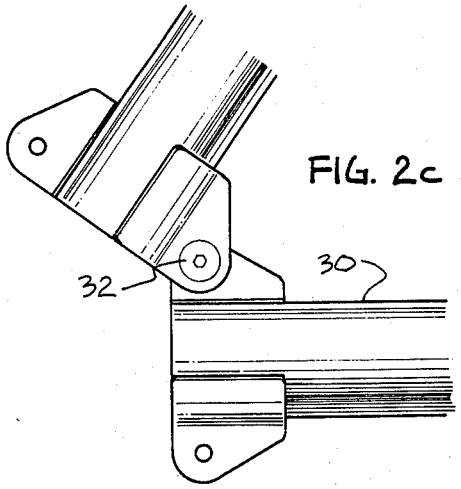
FIG. 2c

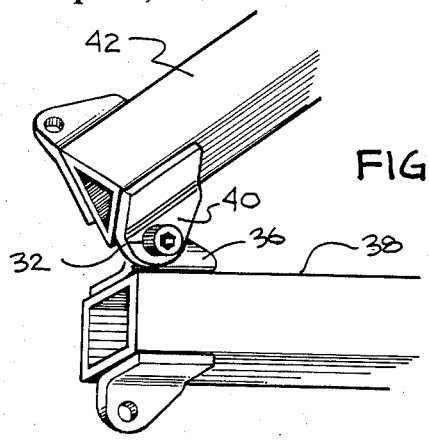
FIG. 8
FIG. 9a
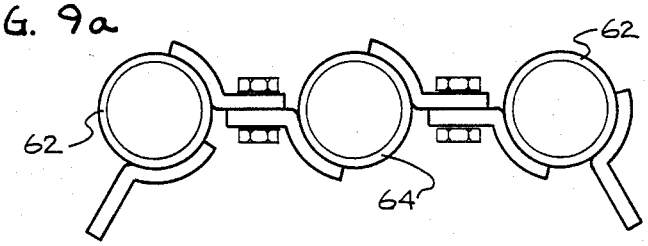
FIG. 9b
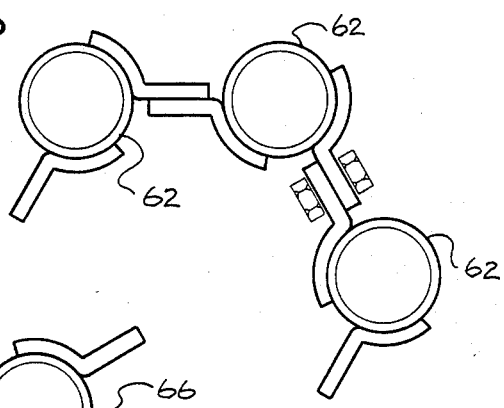
FIG. 9c
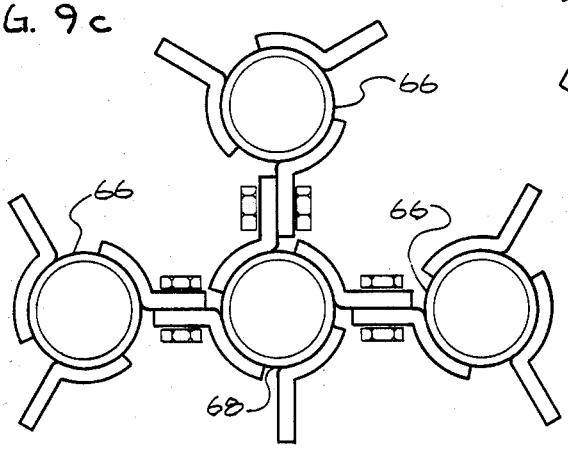

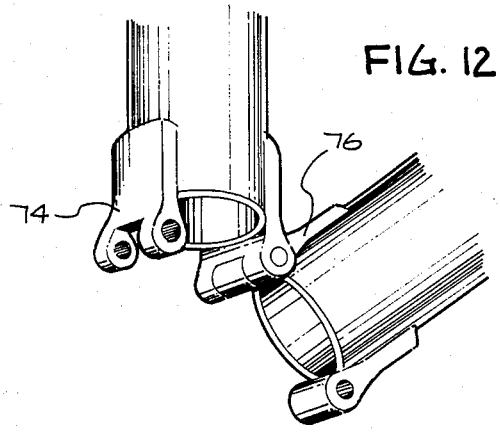
FIG. 12
FIG. 13a
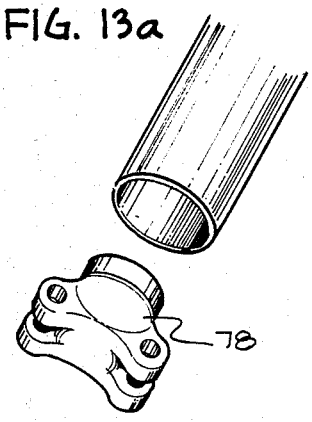
FIG. 13b
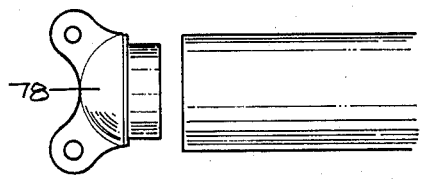
FIG. 13c
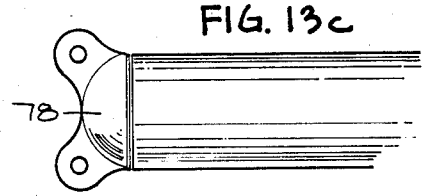
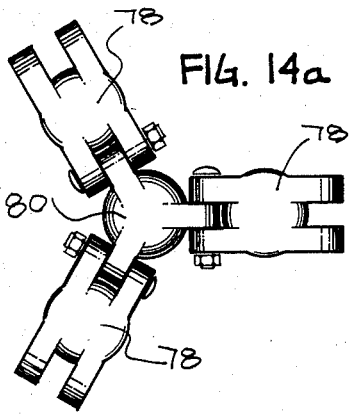
FIG. 14a
FIG. 14b
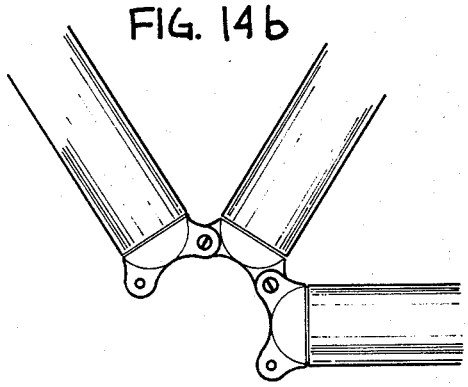

JOINING SYSTEM FOR TRIANGULATED STRUCTURES

This application corresponds to and claims the priority of British Application Ser. No. 41000/77, filed Oct. 3, 1977 and PCT/US78/00100, filed Oct. 3, 1978, which claimed priority therefrom, but which was abandoned in favor of the present application.

FIELD OF THE INVENTION

The present invention relates to building structures having prefabricated components whose struts must be joined, and in particular, to a hinge joining arrangement for interconnecting the struts of triangulated space frame type structures.

DESCRIPTION OF THE PRIOR ART

Triangulated framework space structures include planar space frames for building roofs and walls, domes, such as geodesic domes and the like, and complex convexoconcave structures. Such structures possess a certain symmetry and direction characteristic such as is explained and described in my earlier issued U.S. Pat. No. 3,600,825, and Great Britain Pat. No. 1,354,965. Such building structures frequently comprise planar members whose planes are defined by peripheral struts joined to adjacent structural plane members at the strut ends. An improved strut system which utilized a novel gusset clamp which interconnected strut members at preselected angles is disclosed in my copending application Ser. No. 817,512, filed July 21, 1977 and now abandoned for GUSSET CLAMP JOINING SYSTEM FOR TRIANGULATED SPACE STRUCTURES.

Except these approaches, the classic and pervasive solution to the problem of joining a plurality of struts at a single point is to join the struts to an additional nodal element or component. Such an approach is exemplified by the so-called German "Mero" system described by Borrego, *Space Grid Structures,* (the MIT Press, 1968) at pages 18–21, and by the so-called U.S. "Unistrut" system, at pages 30–33 of the Borrego, and the "Triodetic" system from Canada.

It has long been thought to continue improvements in such prefabricated linear strut members so that they may be joined at their ends simply, and with fewer parts so to facilitate their assembly into a fully triangulated framework space structure where a plurality of strut members meet at a typical, nodal domain.

One such approach was described in the patent to R. B. Fuller, No. 2,986,241, issued May 30, 1961, for "SYNERGETIC BUILDING CONSTRUCTION". In FIGS. 7–13 inclusive, strut members were shown which terminated in generally "X" shaped ends that were drilled to receive fasteners. The drilled ends or flanges were arranged in what Fuller termed "overlapping" or "plus or minus turbining" and appear to be joined in a node including six axii or struts radiating outwardly from the centre of a hexagon with three struts as the apex of a tetrahedron below and/or above the node. All struts were of the same length and all structures were based on a common octahedron-tetrahedron system.

SUMMARY OF THE INVENTION

According to the present invention a system is disclosed which provides much greater versatility at lower cost than other systems including that of Fuller (supra).

The system is predicated on the principle that no central nodal component is required (whether said nodal component is homogeneous or segmented), but that the ends of the struts themselves may be attached one to another directly, thereby eliminating the need (and therefore the manufacturing complexities, cost and weight) of a nodal component. Fuller, while avoiding the nodal component, teaches a structure that generally requires the interconnection of at least three but generally more struts at each "node".

The means by which such joining of struts together without use of nodal components may be called the "polyhinge" or "multi-hinge" joining system. Such multi-hinge joints enable as few as two strut ends to be joined at a single "nodal domain", or as many as 100 or more to be joined at a single nodal domain. This versatility is not matched by any other joining system, except the earlier gusset clamp joining system of the copending application.

The multi-hinge joint system consists generally of paired, hinge-like elements. Such hinge-like elements can take many forms. In general, each hinge half is attached to a strut end such that two strut ends may be joined by means of a nut and bolt or other hinge pin equivalent.

In order to join a plurality of struts together at a single nodal domain, each strut end is joined to its nearest neighbour (and in some instances its next nearest neighbour as well). As a result, each strut end is usually connected, by means of the multi-hinge joint, to two neighbouring strut ends, although in certain cases each strut end can be attached to three, four or six neighbours. Since the multi-hinge joint can adjust to any required angle, the joint elements can be standardized, while accommodating an extraordinary range of configuration and degree of complexity.

Because triangulated structures have inherent geometric stability, rigid space frames are produced in spite of the fact of a hingeable connection. Also, because the struts are attached directly, one to another, without the intermediary of a central nodal connection, multiple polyhinge joint stability is insured. This overall joint stability results directly from the angular stability about each polyhinge joint which is provided by the triangular frame to which it belongs as one of its three apices.

Indeed, localized joint stability is so completely dependent upon the global geometric stability of a structural frame, that any combination of struts meeting at a nodal domain, provided that the structure to which they belong is stable, will form a stable joint. As few as three and as many as 6, 8, 10, 14, 26 or ever 100 struts meeting at a nodal domain will be stable.

In alternative embodiments, the hinge elements may be as simple as an apertured flange fastened to the exterior surface of a strut member which functions as a single shear connector element. More complex hinges can include double and triple shear versions.

In a double shear hinge connector, the yoke or female hinge elements would be placed on both ends of a strut. The complementary central, or male hinge element would then be placed at both ends of a second strut. This embodiment requires a doubled inventory of "male" and "female" struts.

A triple shear embodiment is also possible. Here, however, only a single hinge element is required since each is a yoke element, and two yokes can be easily connected together. The various embodiments can be connected by bolts, threaded fasteners or pins. If pins are used, they can be secured by split ring washers, sometimes known as circlips or with cotter pins.

The novel features which are believed to be characteristic of the invention, both as to organization and method or operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 including FIGS. 1*a* and 1*b* are end and side views, respectively, of a typical multi-hinge, single shear element;

FIG. 2 is comprised of FIGS. 2*a*–2*d* in which FIG. 2*a* is a side view of two multi-hinge elements of FIG. 1 fastened to a tubular strut member, FIG. 2*b* is a perspective view of the strut of FIG. 2*a*, and FIGS. 2*c* and 2*d* are a side and perspective view, respectively, of two struts joined their hinge elements;

FIG. 3 including

FIG. 4 including

FIG. 5, including

FIG. 6 including

FIG. 7 including

FIG. 8 is a perspective view of a strut according to FIG. 6*a* being joined to a strut according to FIG. 5*a*;

FIG. 9 including FIGS. 9*a*–9*c*, are end views of various arrangements of interconnected struts;

FIG. 12 is a perspective view of a pair of struts with double shear hinge elements being connected;

FIG. 13 including FIGS. 13*a*, *b* and *c* are respectively a perspective exploded end and side views of a tubular strut member utilizing a plug having double shear hinge elements;

FIG. 14 including FIGS. 14*a* and *b* are an end view and a side view respectively of the struts of FIGS. 13 joined together;

FIG. 21 including

DESCRIPTION OF THE PREFERRED EMBODIMENT

Figure 3A:
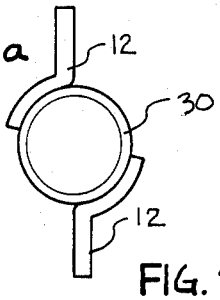
FIGS. 3*a*–3*e*, are end views of struts with from two to six multi-hinge elements attached at various orientations.

Turning first to FIG. 1, which includes FIGS. 1*a* and 1*b*, there is shown an end and side view, respectively, a preferred embodiment of a typical multi-hinge element 12. As shown, the element includes a hinging portion 14 and an attaching portion 16. The hinging portion 14 includes an aperture 18 to which a fastening element may be used to connect two hinge elements together.

As best seen in FIG. 1*a*, the typical multi-hinge element 12 is designed for attachment to a tubular strut member 20. The curvature of the attaching portion 16 is designed to conform to the radius of curvature of the tube 20 and the hinging portion 14 is then angled so that the attaching surface is in a plane 22 that includes the central axis 24 of the strut 20. In the preferred embodiment, the pivotal or hinge axis 26 of the multi-hinge element is then perpendicular to the plane 22.

The multi-hinge element 12 may be fastened to the tubular strut 20 by many techniques, depending upon the materials employed. Preferably, a joining technique is used which results in a strong bond between the strut and hinge. Multi-hinge elements can easily be produced in a variety of shapes and styles and in many different materials and by means of varying techniques. Iron, steel, aluminium, and reinforced plastics may be used.

In the case of metallic materials, the techniques suitable for mass production of the hinge elements may include stamping, casting, forging and sintering and joining techniques including welding and brazing. If plastics are to be used, injection and compression moulding may be used in addition to stamping and forming and comparable joining techniques can be used with the inclusion of adhesives, as well.

As seen in FIG. 1*b*, the hinge element 12 may be elongated in the axial direction to provide a greater bonding area to the strut 20 and to supply additional resistance to twisting.

Turning next to FIG. 2 which includes FIGS. 2*a*–2*d*, a typical tubular strut element 30 is shown in side view in FIG. 2*a* and in perspective in FIG. 2*b*. As shown in FIG. 2*a*, the strut element 30 has welded to it two multi-hinge elements 12 separated by 180°. As can be seen from the perspective view of FIG. 2*b*, a plane passing through the central axis of the strut 30 that is tangent to the hinging portion 14 of one of the multi-hinge elements 12 will also be tangent to the other multi-hinge element hinging portion, but on opposite sides of the plane.

The interconnection of two similar struts 30 is illustrated in side view and in perspective view in FIGS. 2*c* and 2*d* respectively. As shown, a fastening element 32 serves as a hinge axis and aligns the two strut elements so that their central axes are coplanar. In FIGS. 2*c* and *d*, the fastening element 32 is a hinge pin nut and bolt.

In FIG. 3 which includes FIGS. 3*a*–3*e*, several alternative multi-hinge element placements are shown for a strut member. As in the Fuller patent, the attaching surface of each hinge element 12 is tangent to a plane through the centre of the strut and hinge elements which are radially positioned 180° apart are on opposite sides of a common plane.

Figure 3B:
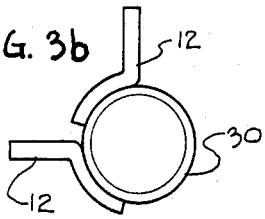
Figure 3C:
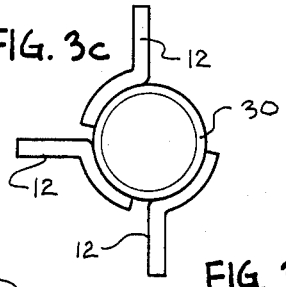
Figure 3D:
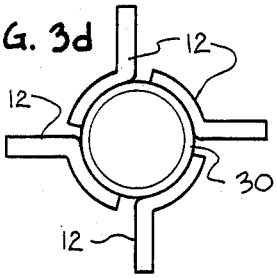
Figure 3E:
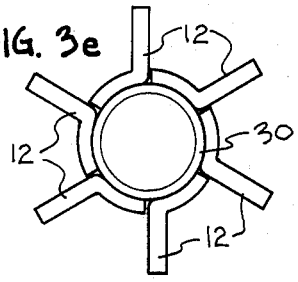

In FIG. 3*a*, a strut member is illustrated with a pair of hinge elements 12 separated by 180° while FIG. 3*b* illustrates a strut with two multi-hinge elements separated by 90°. In FIG. 3*c*, there is shown an embodiment which in effect, combines the showing of FIGS. 3*a* and 3*b* to result in a strut with three multi-hinge elements positioned, utilizing a "clock notation" at 12 o'clock, 6 o'clock and 9 o'clock. Equally spaced multi-hinge elements are shown in FIGS. 3*d* and 3*e* wherein four equally spaced elements are shown in FIG. 3*d* and six equally spaced elements are shown in FIG. 3*e*.

Turning next to FIG. 4, there is illustrated several possible alternative combinations and angular positionings in the attachment of the multi-hinge elements to the tubular strut ends. The shading utilized in FIG. 4 is intended to indicate the position of a hinge element which is fastened to the remote end of a strut element while the unshaded element is intended to represent the hinge element at the near end of the strut member.

Any given strut end can, as shown in FIG. 3, have a plurality of radially disposed multi-hinge elements attached to it. The number of multi-hinge elements that can be usefully attached to a given strut end is a function of the inherent symmetry of the axis along which the strut is directed and the position of the neighbouring struts to which it is to be joined. For example, it is known from the teaching of the Pearce Pat. No. 3,600,825 that any direction that a strut may take emanating from a nodal point of origin will have a characteristic symmetry axis of n-fold rotational symmetry (or at least a single mirror plane—so-called bilateral symmetry, e.g. Isoceles triangle).

Figure 4A:
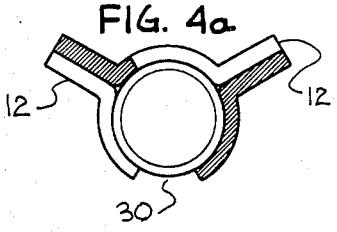
FIGS. 4*a*–4*e*, are end views of a plurality of struts with multi-hinge elements attached in which the elements at the relatively remote end of the strut are shown as shaded so that the relationship between the radial orientation of the hinge elements at one end and at the other end can be observed.

Usually, although not always, the n-fold rotational symmetry of a given strut axis will correspond to the number of adjacent neighbouring struts to which it must (or may) be attached. Such n-fold rotational symmetry will usually dictate the angular positioning of the multi-hinge elements about the axis of the tubular strut. For example, the embodiments illustrated in FIG. 3 are based on a four-fold symmetry while the embodiments illustrated in FIG. 4 represent variations based on a three-fold symmetry. In FIGS. 4*a*, *b* and *c* there are illustrated, struts having two hinge elements at each end. As could be expected, the possible variations include the combination where the hinge elements at opposite ends are tangent to the same plane (as in FIG. 4*a*) or, (as in FIGS. 4*b* and 4*c*) only one of the three defined planes has two hinge elements tangent to it.

Figure 4B:
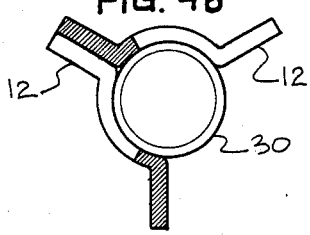
Figure 4C:
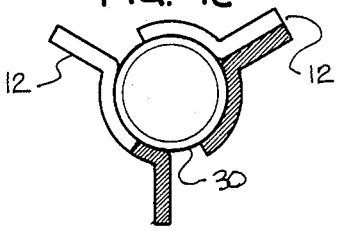
Figure 4D:
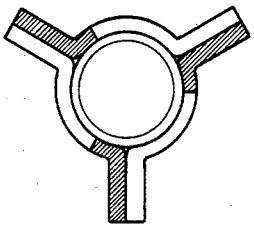

In FIG. 4*d*, each end of the strut has three multi-hinge elements equally displaced about the circumference. The elements at the opposite end are placed to intercept the same planes. However, in FIG. 4*e*, the hinge elements at one end are rotated relative to the hinge elements at the opposite end, so that diammetrically opposite hinge elements are tangent to the same plane.

Figure 5A:
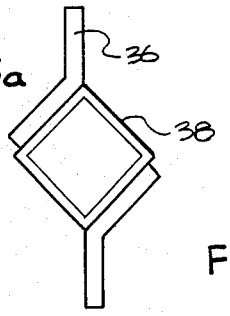
FIGS. 5*a*–5*e* are end views of square struts to which multi-hinge elements have been applied.
Figure 5B:
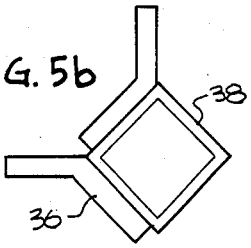

A modified multi-hinge element 36 is required for use with a square tubular strut 38. The modification is primarily made to the attaching portion which must be planar in order to attach to the flat side of the strut 38. As shown in FIG. 5*a*, a pair of multi-hinge elements are positioned on opposite sides of the strut 38 while, in FIG. 5*b*, a pair of multi-hinge elements are positioned adjacent one another, separated by 90°.

Figure 5C:
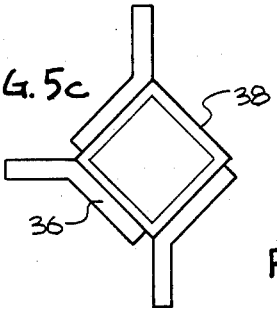
Figure 5D:
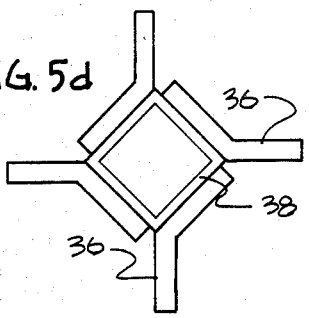

In other variations, a three hinge element embodiment is shown in FIG. 5*c* with hinge elements 36 on three of the four faces while, in FIG. 5*d* there is shown a strut 38 with hinge elements 36 on each of the sides.

As in other embodiments, the hinge elements are arranged to be on opposite sides of a plane which passes through the centre of the strut. Struts that are connected in parallel would then have their centres lying in a common plane.

Figure 5E:
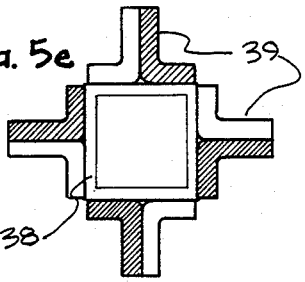

FIG. 5*e* illustrates an interesting variation of the struts of FIGS. 5*a*–*d*. Here a square tubular strut 38 utilizes right angled hinging elements 39. These hinging elements 39 are arranged so as to be on opposite sides of a plane which passes through the central axis of the strut 38 and each hinging element 39 has a right angle between the attaching portion and the hinging portion.

Figure 6A:
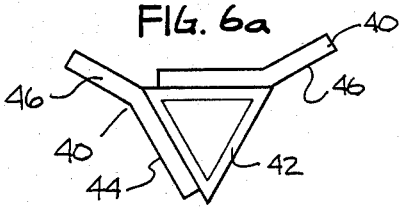
FIGS. 6*a*–6*c*, illustrates multi-hinge elements attached to a triangular strut.
Figure 6B:
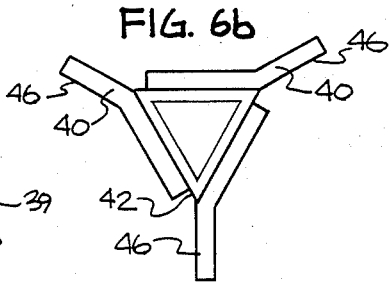
Figure 6C:
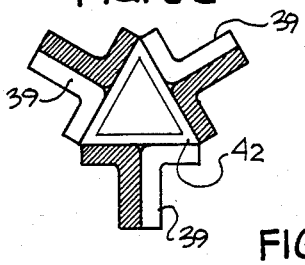

Triangular tubular struts are shown in FIGS. 6*a*, 6*b* and 6*c*. The multi-hinge element 40 which is connected to the triangular strut 42, is modified as in FIG. 5 so that the attaching portion 44 is substantially planar and the hinging portion 46 extends to be parallel to a plane including the central axis of the tubular strut 42. That plane is a perpendicular bisector of the angle at the apex which is adjacent the hinging portion 46. In FIG. 6*a*, there is shown a strut with two multi-hinge elements while in FIG. 6*b*, three multi-hinge elements are provided. These struts are useful in applications requiring three-fold and six-fold symmetry.

FIG. 6*c* illustrates the use of a right angle hinge element 39 as applied to a triangular strut 42. As before, the shading indicates a hinge element fastened to a remote end of the strut while the unshaded hinge elements are mounted at the near end of the strut. In the illustrated configuration, the hinging surface is tangent to a plane through the central axis of the strut that bisects the side upon which the hinge element 39 is fastened.

Figure 7A:
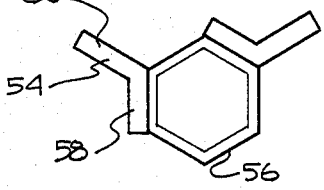
FIGS. 7*a*–7*c*, illustrate the application of multi-hinge elements to a hexagonal tube with shading utilized to differentiate the multi-hinge elements positioned at the near end of the strut from those at the far end of the strut.

In FIG. 7*a*, there is shown a hinge element 54 which is adapted for use with a hexagonal tubular strut 56. As with the hinge 40 in FIG. 6, there is a flat attaching portion 58 adapted to fasten to a surface. The hinging portion 60 is angled to be tangent to a plane passing through the apex and the central axis of the hexagonal tubing 56.

Figure 7B:
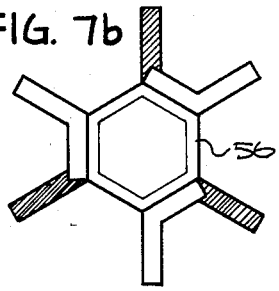
Figure 7C:
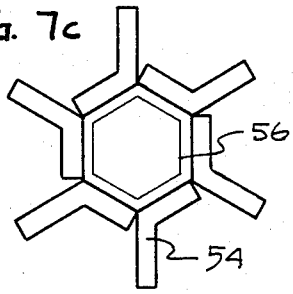

In FIG. 7*b*, utilizing the convention of shading the hinging elements 54 at the remote end of the strut 56, a configuration is shown where hinging elements at one end are on alternate apices. The hinge elements 54 at the other end of the strut 56 similarly alternate, but with a rotation of 60°. In the embodiment illustrated in FIG. 7*c*, six hinging elements 54 are shown disposed around one end of the strut 56. This embodiment is used in structures of six-fold symmetry.

Turning next to FIG. 8, there is shown a strut 42, such as is shown in FIG. 6*a*, connected to a strut 38, such as shown in FIG. 5*a*. A fastening element 32 functions as both a hinge pin and a bolt.

In FIG. 9, which includes FIGS. 9*a*–9*c*, there are shown typical struts bolted together in which different arrangements of multi-hinge attachments angles are assembled into particular configurations. In FIG. 9*a*, for example, a first strut 62, such as is shown in FIG. 4*a*, 4*b* or 4*c*, is connected to a second strut 64, such as is shown in FIG. 3*a*. This, in turn, is connected to another, first strut 62. The resulting structure provides parallel struts which could support a plane surface. In the alternative configuration of FIG. 9*b*, three substantially identical first struts 62 are interconnected together.

Figure 4E:
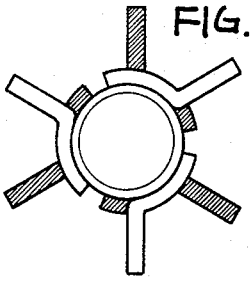

In the embodiment of FIG. 9*c*, three struts 66 of the type shown in FIG. 4*d* or 4*e*, are each connected to a strut 68 such as is shown in FIG. 3*d*.

While the end view of FIG. 9 creates the impression that each of the struts is connected in a way that to arrange all of the strut axes to be parallel, it is clear that in typical, triangulated structures, the different struts would be rotated on their hinge axes, so that the triangulation could be achieved.

Figure 10:
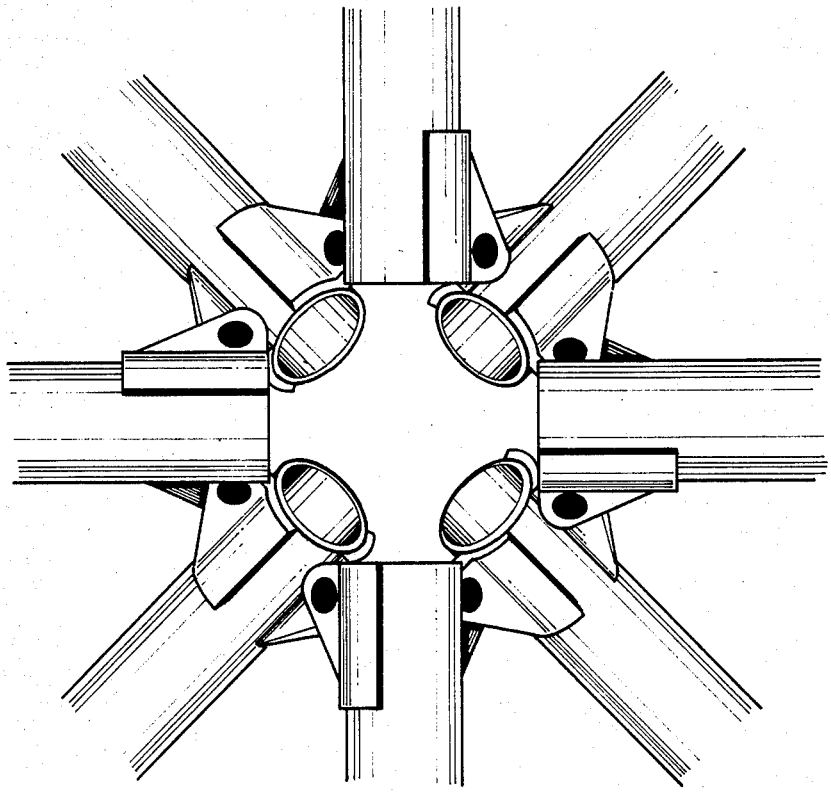
FIG. 10 is a side, partially perspective view of eight struts being joined in a common vertex.

For example, in FIG. 10, there can be seen a typical space frame joint in which eight strut ends meet at a single nodal domain, including four coplanar struts and four oblique struts. Each strut end has two hinge elements attached to it. The coplanar struts are all identical with a 90° angular displacement of hinge elements (such as shown in FIG. 3*b*), while the oblique members, which are also identical, exhibit a 120° angular displacement of hinge elements, (such as is shown in FIGS. 4*d* or 4*e*).

Figure 11:
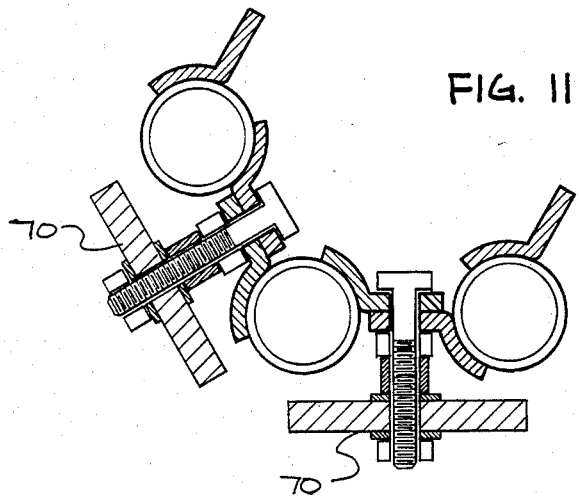
FIG. 11 is an end view of three struts being joined together with a connector that is adapted to attach other structural elements.

When paired hinge elements are bolted together, said bolts may be extended and lengthened to provide a basis for the attachment of interstitial panel 70. This is shown schematically in FIG. 11. Such a system of panel attachment is highly consistent with the structural behaviour of fully triangulated framework structures. Since this system insures that loads on the panel surfaces, e.g. wind, will be transmitted directly to the nodes of the structure, the pure axial (tension, compression) loads will be preserved. This strategy enables optimum efficiency (strength to weight) of the framework.

As was noted above, the multi-hinge joint elements can be produced in various styles, and in various materials. In FIG. 12, there is shown one alternative style of multi-hinge element which is commonly known as the double shear joint. Such a hinge element can be made by forging, casting or stamping or can be produced from sintered metal.

In FIG. 12 a hinge element 74 is shown as a "yoke" or "female" double shear element which fastens to a corresponding hinge element 76, that is adapted to fit in the yoke. The combination is secured by a pin or bolt. In the illustration of FIG. 12, the hinge elements are fastened directly to struts while in FIGS. 13 and 14, the hinge elements illustrated therein are separate structures which include all of the necessary hinge elements in an end piece that is fastened to the tubular strut. This superficially resembles the approach taught by Fuller, supra, in FIGS. 10 and 11.

In FIG. 13, a female yoke 78 is shown which can be inserted and secured to the open end of a tubular strut member. FIGS. 13*b* and *c* are side views showing the element before and after insertion into the strut. Similarly, FIG. 14 shows three of the female or yoke hinge elements 78 coupled to an end piece 80 which includes three male hinge elements. In FIG. 14*b*, a coupling of two female elements to a single male element is shown.

Figure 15:
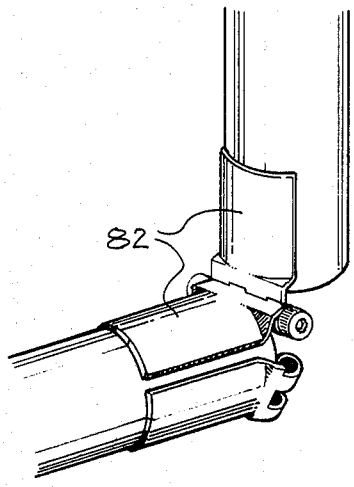
FIG. 15 is a perspective view of a pair of struts joined together utilizing a triple shear hinge element.

FIG. 15 shows an alternative hinge element of the triple shear type 82 in which two yoke elements are intercoupled in an "overlapping" fashion and secured with a pin. Two struts so equipped are connected in FIG. 15. In this embodiment, the hinge elements 82 are arranged so that the hinging portions are directed inwardly.

Figure 16A:
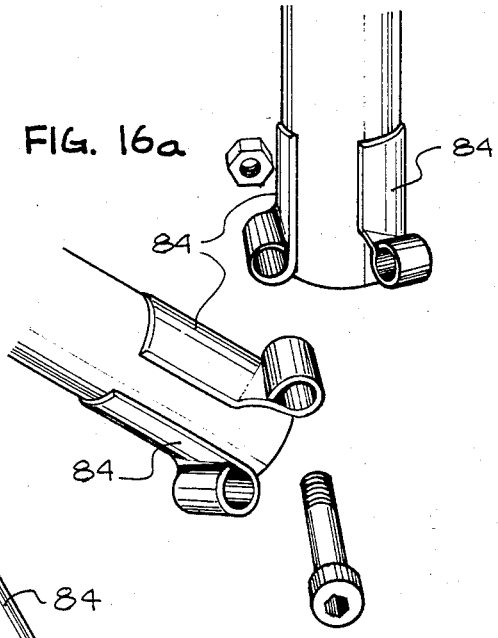
FIG. 16 including FIGS. 16*a* and *b* are an exploded and connected perspective view respectively of a pair of single shear hinge elements attached to tubular struts joined by a bolt member.
Figure 16B:
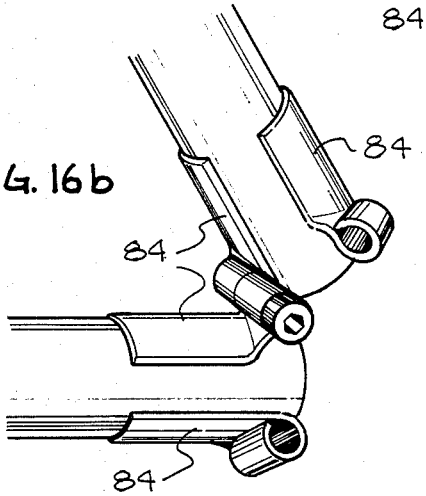
Figure 17A:
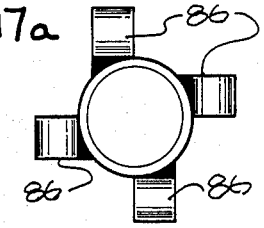
FIG. 17 including FIGS. 7*a*, *b*, *c* and *d* are end and side views respectively of a tubular member including four multi-hinge elements and three multi-hinge elements.
Figure 17B:
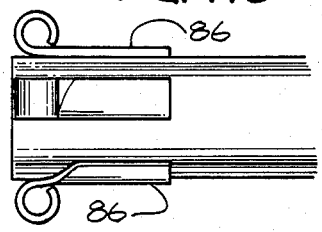
Figure 17C:
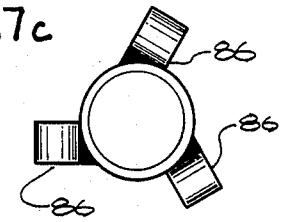
Figure 17D:
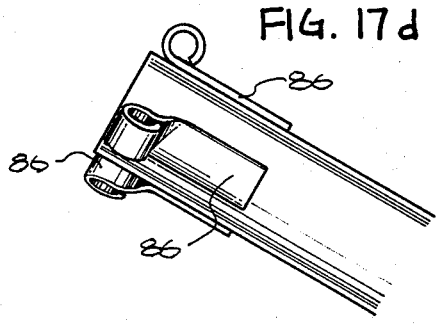
Figure 18:
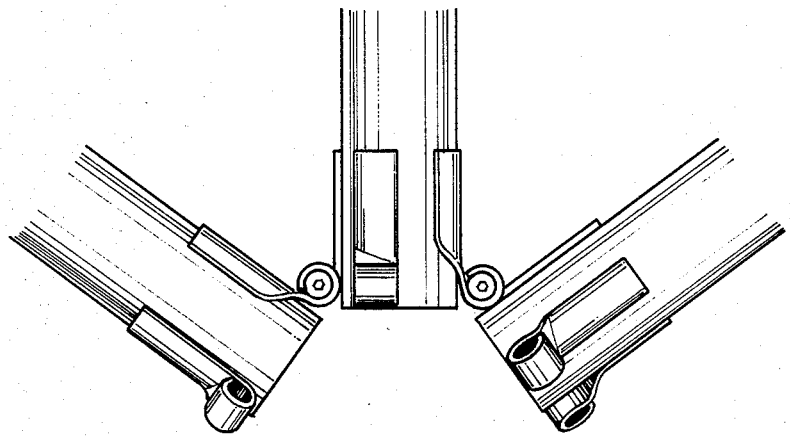
FIG. 18 is a perspective view of three strut elements of FIG. 17 joined together.

In FIG. 16 through 18, there are illustrated yet another style of multi-hinge element 84 consisting of a stamped, metal hinge half with a rolled end 86. The hinge element 84 is then resistance welded to a strut. FIG. 16*a* is an exploded view of the connected pair of strut elements illustrated in FIG. 16*b*.

The placement of hinge elements on struts as shown above, can be employed no matter what the type of hinge element is used. As seen in FIG. 16, the stamped hinge 84 requires a bend before creating the rolled end 86 so that the axis of the aperture at the rolled end will be perpendicular to a plane passing through the fastening edge of the rolled end 86 and the central axis of the strut.

The rolled end 86 is oriented to be exterior of the strut. This differs from the orientation of the embodiments of FIG. 15, which are intended to be used with larger struts in order to minimize the area required for the attachments. Typically, a more or less normal sized strut would have an outside diameter of under $2\frac{1}{2}''$. Larger diameter struts would then be considered oversized and special considerations would dictate the placement of the hinge elements.

That relationship can best be seen from the end views of FIGS. 17*a* and 17*c* in which a four-fold symmetry is shown with the rolled ends equiangularly spaced about the strut while in FIG. 17*c* a three-fold symmetry is shown with three hinge elements 84 equiangularly displaced about the strut. FIGS. 17*b* and 17*d* represent side views respectively illustrating FIG. 17*a* and 17*c*.

Figure 19:
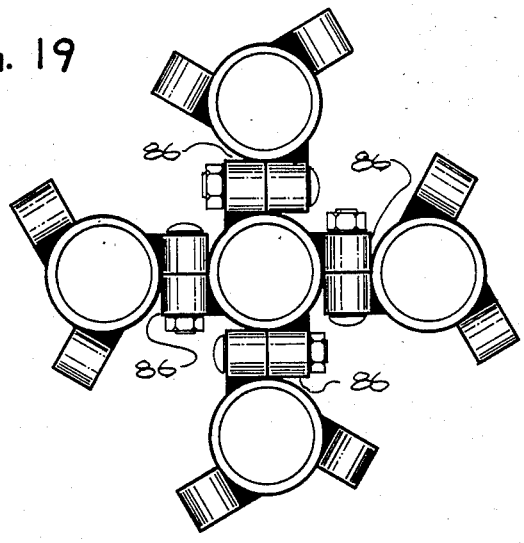
FIG. 19 is an end view of five strut elements joined together with their respective hinges.

In FIG. 18, three struts using stamped, metal hinge elements 84 are shown interconnected together. In FIG. 19, four of the struts of FIG. 17*c* are shown connected to the four rolled ends 86 of a strut such as is shown in FIG. 17*a*.

Figure 20A:
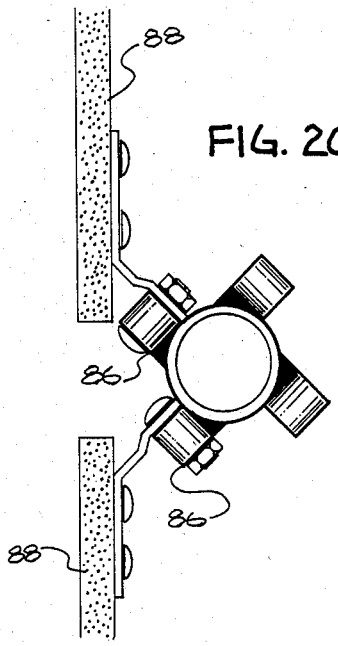
FIG. 20 including FIGS. 20*a* and *b* are end views of tubular struts in which panel members are joined to a strut member using the multi-hinge element and showing the connections of a multi-hinge element.

In FIGS. 20 and 21, the struts of FIGS. 16 through 19 are shown connected to panel 88. In FIG. 20 the strut of FIG. 17*a* is utilized while in FIG. 21, the strut of FIG. 17*c* is utilized. Slight variations in the panels 88 and modes of attachment may be necessary to accommodate the angular orientation of the multi-hinge element in order to achieve a planar structure.

Figure 20B:
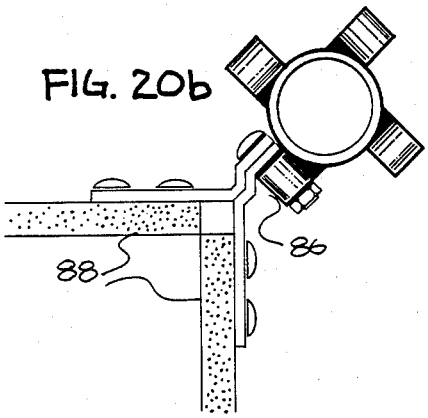
Figure 21A:
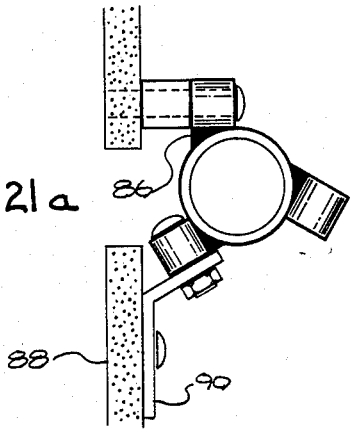
FIGS. 21*a* and 21*b* are end views of still another embodiment of a multi-hinge strut element with attachments to the hinge elements.
Figure 21B:
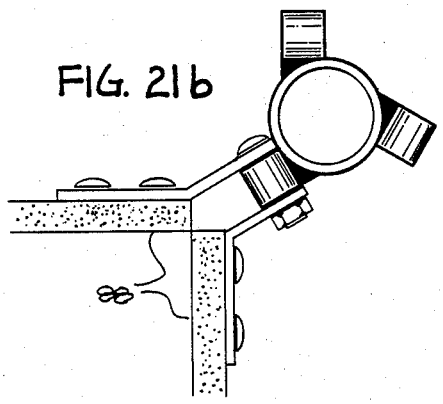

For example, in FIG. 21*a*, a panel 88 can be directly bolted to a rolled end 86 while a second, parallel panel 88 would first be fastened to an angle iron 90 which would then bolt to a second rolled end 86 of a second hinge element on the strut. Similarly, in FIG. 21*b*, a modification of the attachment system of FIG. 20*b* is required when the three hinge strut of FIG. 21 is used in place of the four hinge strut of FIG. 20.

All variations shown in the Figures included herewith constitute viable alternatives to the same system of joining. Which alternatives one chooses would depend on materials, the scale of the struts and joining components, and the magnitude of the stresses that are likely to be encountered in a given structure as well as other criteria that may be imposed by the designer.

All variations anticipate the basic condition of triangulated space frame systems which is that no bending moments are induced in a joint. Forces always remains in an axial mode of either pure compression of pure tension, up to the point of buckling. Because the multi-hinge joint system is intended for use in triangulated structural systems, a range of angular accommodation can be anticipated from 30° to 90°, although angles of less than 30° can easily be accommodated by multi-hinge joint assemblies.

A typical complex application of the multi-hinge joint system would be the accommodation of the twenty-six directions of the universal node (disclosed and claimed in the Pearce Pat. No. 3,600,825). In that element, twenty-six different struts met at a common nodal domain or point. To complete a full universal node would require forty-eight pairs of hinge elements joined together with forty-eight hinge pins or bolts.

As noted above, as few as three struts can be joined in a nodal domain or, as many as one hundred struts can be joined. Therefore, the meeting of twenty-six struts is a condition of only moderate complexity which, when satisfied would produce a fully stable joint.

With the system of the present invention, all structural framing components, including strut lengths and multi-hinge positions can be fully prefabricated in the factory, ready for assembly. On site assembly is simply accomplished by sequential bolting or pinning together of strut ends.

It can also be seen that the system is easily adaptable to circular tubes or other geometrical shapes. It has been determined that tubular members are desirable because of their high strength to weight ratios. However, it would be within the skill of the art to adapt the present invention to strut elements of yet other structural shapes or configurations, for example, such as are shown in the patent to Fuller, supra. The individual hinge element can easily be mass produced for each type of strut.

Of course, other variations are possible, for example, when dealing with oversize struts that would require a reduced diameter in the area of the hinge element. Yet other variations will appear to those skilled in the art and accordingly, the invention should only be limited by the scope of the claims appended hereto.

INDUSTRIAL APPLICABILITY

The present invention finds industrial application in the provision of civil engineering and other structures.

I claim:

1. A triangulated structural assembly including a plurality of elongated structural elements, each of which elements is permanently provided with at least two integral connector means at each end thereof and in which each elongated structural element is pivotally connected directly to at least one further structural element in non-colinear alignment by their connector means about a pivot axis which is transverse to the longitudinal axes of the elongated structural elements, said pivot axis being displaced from the central axis of said structural element; each connector means comprising an axially elongated attaching portion about said structural element and an assymetrical radially extending hinging portion along the length thereof and secured to said structural element and including a bore for a pivot pin.

2. An assembly as claimed in claim 1 in which the pivot axis of each said connector means is disposed within the length of the general envelope of said structural element itself, but outside the general envelope of said structural element.

3. An assembly as claimed in claim 1 in which said connector means further include an attachment portion contiguous along its length with said hinging portion for securing said connector means to said structural element.

4. Said hinging portion an assembly as claimed in claim 3 in which the bracket is formed from sheet material and the pivot axis extends normal to the material of said hinging portion.

5. An assembly as claimed in claim 4 in which said attaching portion is formed to conform with the part of the surface of the structural element to which it is attached.

6. An assembly as claimed in claim 3 in which said hinging portion of the connector means has an abutment face to engage the corresponding part of a further element to which it may be connected, that abutment face lying transverse to the pivot axis and in a plane which passes through the longitudinal axis of the structural element.

7. An assembly as claimed in claim 1 in which said hinging portion is attached to the structural element by welding or bonding.

8. An assembly as claimed in claim 3 in which the bracket is attached to the structural element by means of welding.

9. An assembly as claimed in claim 3 having a plurality of said connector means disposed around end.

10. An assembly as claimed in claim 9 in which the plurality of connector means are equally spaced about the longitudinal axis of the structural element.

11. An assembly as claimed in claim 1 in which the structural elements are formed from circular cross-section tube.

12. An assembly as claimed in claim 1 in which the structural elements are formed from polygonal cross-section tube.

13. An assembly as claimed in claim 1 in which the connector means of adjacent ones of the elements are connected by means of a pivot pin.

14. An assembly as claimed in claim 13 in which each pivot pin comprises a screw-threaded bolt with a retaining nut.

15. An assembly as claimed in claim 13 in which further structural items are connected to the assembly of said structural elements by means of one or more said pivot pin or pins.

* * * * *